US005600860A

United States Patent [19]

Marnetto

[11] Patent Number: 5,600,860

[45] Date of Patent: Feb. 11, 1997

[54] DILATION JOINT FOR BRIDGES AND VIADUCTS

[75] Inventor: Roberto Marnetto, Rome, Italy

[73] Assignee: T.I.S. S.p.A., Rome, Italy

[21] Appl. No.: 265,442

[22] Filed: Jun. 24, 1994

[30] Foreign Application Priority Data

Jun. 24, 1993 [IT] Italy ..... 93A000417

[51] Int. Cl.[6] ..... E01D 19/06

[52] U.S. Cl. ..... 14/73.1; 14/73.5; 404/57; 404/60

[58] Field of Search ..... 14/73, 73.1, 73.5; 404/47, 53, 54, 56, 57, 58, 60

[56] References Cited

FOREIGN PATENT DOCUMENTS 1902548 8/1970 Germany .
2138741 2/1973 Germany .
981946 2/1965 United Kingdom .

*Primary Examiner*—James A. Lisehora
*Attorney, Agent, or Firm*—Brumbaugh, Graves, Donohue & Raymond

[57] ABSTRACT

A dilation joint adjustably interconnecting the structural edges of a bridge opening. The dilation joint includes two continuity metallic plates in a transit plane, connected to the structural edges of the opening and to lower structural elements in such a way that a recess is formed on each side of the opening, each recess formed between one of the metallic plates and its corresponding lower structural element. A support structure spans the opening, supported by both structural edges. The support structure is slidably received in a first one of the recesses, and it slidably supports a deformable transit plane, which is slidably received in the other of the recesses.

9 Claims, 1 Drawing Sheet

DILATION JOINT FOR BRIDGES AND VIADUCTS

BACKGROUND OF THE INVENTION

The present invention is included among the devices realized in order to obtain the functional continuity of the structures, particularly bridges and viaducts. The invention allows to get over those openings, even having big sizes, that usually are present in correspondence of near but not continue separations, where there is the chance of relative motions due to thermal and/or seismic reasons, without that the same determine significant interactions.

The present technology provides the use of various devices, in the most cases characterized by the combination of slidable supporting elements and of deformable elastic elements, serially disposed, in such a way that it is in any case assured the continuity of the road. Other solutions provide the use of undeformable elements, reciprocally slidable, having exactly the same above mentioned scope.

Said technologies are basically characterized by remarkable vertical sizes, so that usually an interference occurs with the supporting structure, thus requiring a suitable adaptation, and by remarkable plan dimensions, with the consequence of stability drawbacks for the same joint with respect to the braking action, to the buckling and to the lifting of the elements during the traffic.

SUMMARY OF THE INVENTION

The above points involve noticeable costs of the devices and expenses for the structural adaptation; very high are also the maintenance costs.

The present invention is particularly advantageous, since:

- in view of the reduced vertical dimensions, the structural interferences are reduced at the minimum level, in some case even eliminating them, being it possible to provide the joint within the thickness of the pavement;
- drastically reduces the maintenance operations, in view of the possibility of having an easy access and of the kind of intervention required;
- optimizes the plan dimensions;
- simplifies the intrinsic realization problems for the same joint, in view of the simple structure characterizing the same.

The invention thus proposes an extremely convenient device. Another advantageous aspect is that of the very high comfort level for the traffic, having a continuous functional sliding plane both in length and in width.

These and other results are obtained, according to the invention, by a road joint characterized by a double opposed bayonet behaviour, employing a deformable plane able to be absorbed or housed during its sliding within the structural articulation originally provided.

It is therefore specific object of the present invention a dilatation joint, particularly suitable for bridges and viaducts having great clearances comprising transit deformable plane means, and support elements sustaining the transit plane to get over the opening, said deformable plane means and said support elements being coupled in such a way that they can slide one with respect to the other, so that the latter can be housed in a recess obtained in a position opposite with respect to a recess where said deformable transit plane means are housed.

Preferably, according to the invention, said joint comprises a first plate, coupled, at one end, at one edge of the opening where the joint is provided, disposed above a plane of the structure; support elements provided between the two edges of the opening to be get over, fixedly connected to the opposite edge of the opening with respect to the one of coupling of said first plate and slidingly coupled to the edge of the opening coupled with said first plate; elastic bearing and sliding means for said support elements; a deformable plane, made up of at least a low flexure stiffness element, having sufficient horizontal stiffness and strength, provided above said support elements, coupled at one end to the free end of said first plate, and, on the other end, slidable on the end of said support elements fixed on the opening; and a second plate, fixed at one end at the edge of the opening where it is not coupled said first plate and provided, on the opposite end, with an engagement aiding surface for the sliding of the free end of said deformable plane.

According to the invention, said first plate is fixed to said edge of the opening by a groove realized in the body containing the road pavement and an intrados projection of the plate housed in said groove.

Still according to the invention said first plate is provided with stiffening ribs corresponding to the interspaces between the support elements.

Said plane of the structure can be provided with sloped grooves, for the down flow of the water, or said plane of the structure can be sloped toward the opening.

Further, said support elements can be made up of normal section bars and have an engagement aiding surface on the end fixed to the opening in order to allow the sliding of said deformable plane.

Said elastic bearing and sliding means can be made up, according to the invention, of rubber slabs or ingots, or by linear contact elements, allowing the relative rotation and sliding.

In a preferred embodiment according to the invention said deformable plane comprises a plurality of interconnected modular strips, preferably provided with coupling means in order to avoid the lifting and/or with anti tearing reinforcement.

Still according to the invention, said second plate is fixed to the edge of the opening by a coupling device similar to the one used for said first plate.

Further, according to the invention, the deformable transit plane disposed above the structural opening is constrained at the structural end opposite with respect to the end upon which it is constrained the support structure to get over the opening, and upon which the same plane is slidably rested.

Moreover, the deformable plane is constrained to the structure by the plate that determines the recess where the motion of the support structure to get over the opening and directly supporting the same deformable plane ends, and can move in a recess defined by the transit plate, fixed to the structure and simply rested on the deformable plane.

Furthermore, the support of the plate on the deformable plane occurs by a surface obtained realizing a blade termination of the same plate, so that said surface is homothetic with respect to the engagement aiding surface of the support for the deformable plane obtained on the elements of the support structure to get over the opening near the hinge joint between the same and the structure.

Finally, the deformable transit plane provides a low flexure stiffness and suitably interacts with the slidable structure placed beneath in order to prevent lifting and/or unstability due to the horizontal action loads, particularly during the breaking.

BRIEF DESCRIPTION OF THE DRAWINGS

The present invention will be now described, for illustrative and not limitative purposes, according to its preferred embodiments, with particular reference to the figures of the enclosed drawings, wherein.

DESCRIPTION OF THE PREFERRED EMBODIMENTS

Figure 1A:
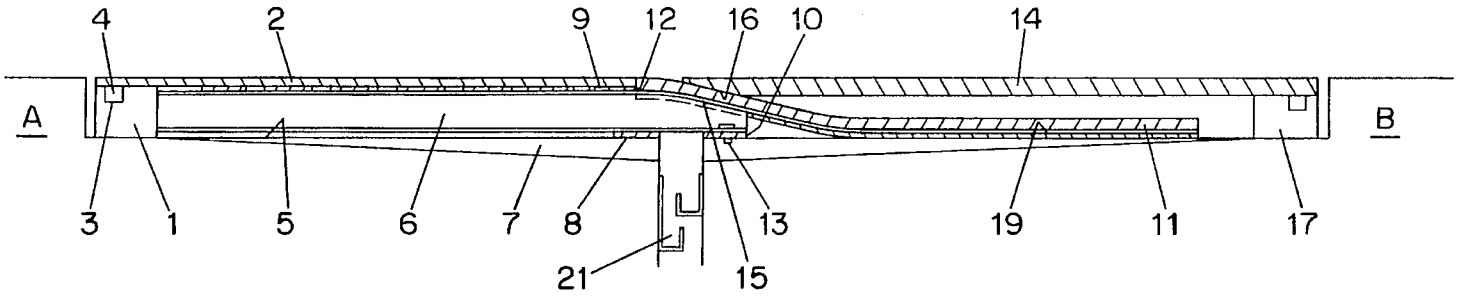
FIGS. 1*a*, 1*b* and 1*c* respectively show the road joint according to the invention in a closed position, in an intermediate position and in an open position.

Particularly, starting from the structural edge of the opening indicated in FIG. 1*a* with the letter "A", the joint according to the invention provides the following elements:

a body 1 containing the road pavement and constraining the plate 2; the constraint of the plate 2 can be suitably realized by a groove 3, provided in the body 1, wherein an intrados projection 4 of the plate 2 is housed;

a load transit plate 2, protecting the opening between the same plate 2 and the plane 5 of the structure "A"; the plate 2 can simply have an uniform thickness, or it can be provided with stiffening ribs disposed in such a way to axially correspond with the interspace between the element 6, as it can be seen from FIG. 1*a*; the plate 2 is fixedly coupled to the edge "A" and constrains the deformable plane 11 by the connections 12;

the plane 5 of the structure "A" can be suitably provided with grooves 7, sloped towards the opening in order to increase the down flow of the eventual percolation water, or it can be simply sloped toward the opening with the same scope, with the exception of the portions supporting the element 8 that must guarantee to the element 6 to move along a plane;

the elements 8, 9 and 10, realizing elastic and sliding support surfaces; they can be realized employing rubber or similar material slabs or ingots, or by linear contact elements, or by any other means that allows to guarantee the rotation and the relative sliding;

the elements 6, realizing the supporting structure to get over the structural opening; they can be realized employing normal section bars; in this case it is wished to use the lateral wings to ensure against the lifting of the deformable plane 11; the elements 6 slide between the elements 8 and 9, and are fixed to the edge "B" of the structure by connections 13 and elements 10; in case the connections 13 are housed within slits having a transverse axis, the joint will be allowed to move also in this direction, as it is often required in case of an earthquake; in correspondence of this edge, the elements 6 are shaped on the upper part in such a way to have an engagement aiding or arcuated sloped plane 15 for the element 11, toward the opening determined by the plate 14 and the underlying plane of the structure "B" (to which the same considerations made for the Edge "A" can be applied);

the element 11, characterized by the fact that has a low flexure stiffness, but is able to provide the necessary stiffness and resistance with respect to the horizontal actions (e.g. braking); the reduced flexure stiffness allows the sliding between the surfaces 15 and 16, and thus to absorb the eventual exceeding length in the recess between the plate 14 and the structure "B"; the element 11 can be made up by interconnected modular strips, each strip can also be provided, in case the material making the element 11 cannot guarantee it independently, with a flexible longitudinal reinforcement, e.g. one or more wire 19, suitably connected to the plate 2, sustaining the traction due to the braking of a vehicle proceeding from "A" toward "B";

the plate 14, fixed at one end at the structure "B" by a coupling assembly 17 similar to the one already described for the coupling of the plate 2, and indicated by the references 1, 3 and 4, and simply rested, on the other end, on the element 11 by the sloped surface 16, homothetic with respect to the surface 15; the plate 14 will suitably have an uniform thickness;

a suitable canalization solution for percolation water, e.g. two channels 21, will be sufficient to the scope.

Figure 1B:
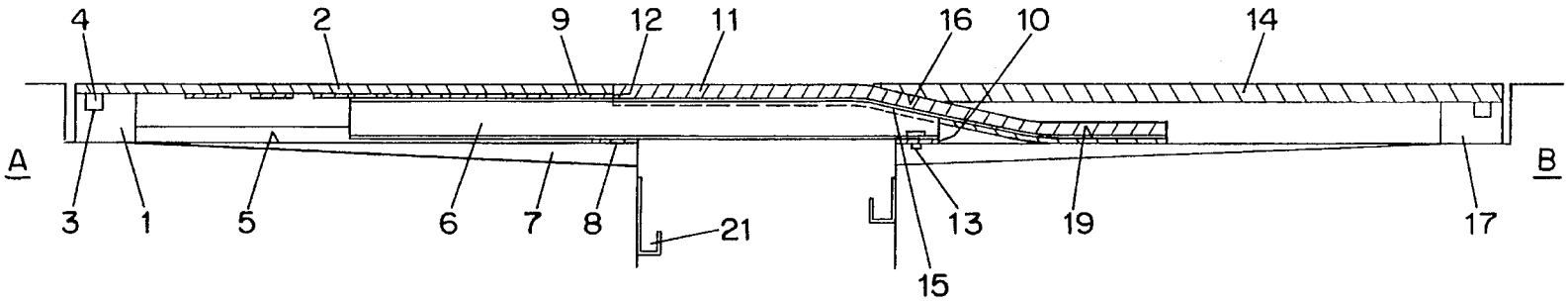
Figure 1C:
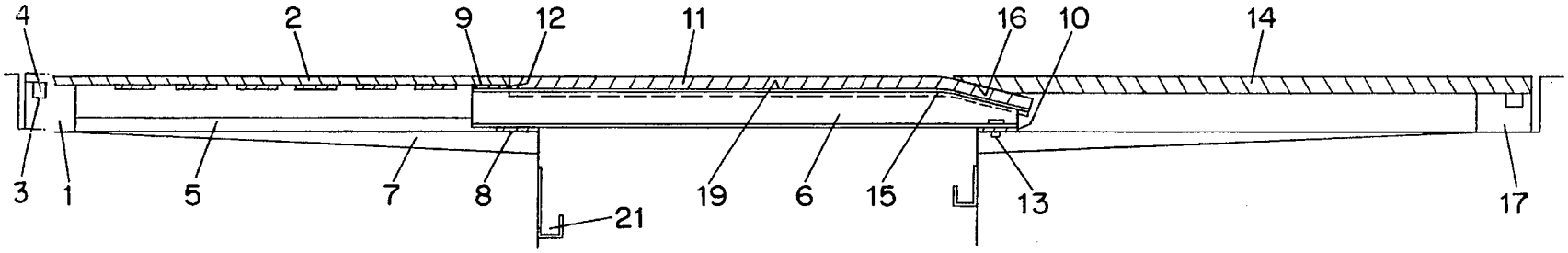

Making reference to the FIG. 1*a* and to the edge "A", the transit plane is realized by the succession of the plate 2, fixed to the edge "A", continuously with respect to the deformable plane 11 and thus to the plate 14, the latter plate being simply rested on the plane 11 and fixed to the edge "B". The structure 6 to get over the opening and supporting the plane 11 is fixed to the edge "B", but slides under the plate 2. Therefore:

when the joint is closed, see FIG. 1*a*, the elements 6 will be all housed in the space between the plate 2 and the edge "A", while the plane 11 will be housed between the plate 14 and the edge "B";

when the joint is completely open, FIG. 1*c*, the elements 6 will be completely out of their housing, as well the plane 11, that will be completely rested on the elements 6;

in the intermediate positions, FIG. 1*b*, both the elements 6 and the plane 11 will be partially housed in the respective spaces.

The present invention has been described for illustrative but not limitative purposes according to its preferred embodiments, but it is to be understood that modifications and/or changes can be introduced by those skilled in the art without departing from the scope of the invention as defined by the appended claims.

I claim:

1. A dilation joint for passage over a structural opening comprising a first structure for disposition on a first side of said structural opening, a second structure for disposition on a second side of said structural opening, a deformable transit plate means for disposition above said structural opening, a support means for spanning across said structural opening, said support means resting on both said first structure and said second structure and slidably supporting said deformable transit plate means, a first load transit plate disposed above said first structure, a first recess located between said first load transit plate and said first structure for slidably receiving said support means between said first load transit plate means and said first structure, a second load transit plate located above said second structure and slidably mounted on said deformable transit plate means, a second recess located between said second load transit plate and said second structure, said deformable transit plate means being slidable within said second recess, said first load transit plate and said second load transit plate lying in a first plane, and said first and second recesses being located substantially in a second plane, wherein said second plane is substantially parallel to said first plane.

2. The dilation joint according to claim 1, wherein said first load transit plate has a first and second end, said first end being slidably engaged with an edge of said first structure and said second end being coupled to said deformable transit plate means.

3. The dilation joint according to claim 2, wherein said second load transit plate has a first and second end, said first end being slidably engaged with an edge of said second structure, and said second end being slidably mounted on said deformable transit plate means.

4. The dilation joint according to claim 3, wherein said second end of said second load transit plate has a bottom surface having an angle such that it rests substantially flush against an upper surface of said deformable transit plate means.

5. The dilation joint according to claim 4, said deformable transit plate means having a low flexure stiffness and, said support means having first and second ends and being slidably coupled with said deformable transit plate means, and said second end of said support means being coupled to said second structure.

6. The dilation joint according to claim 5, said joint further comprising an elastic bearing means and a sliding means for slidably engaging said first end of said support means with said first structure.

7. The dilation joint according to claim 6, said first end of said first load transit plate being positioned in a groove in said edge of said first structure.

8. The dilation joint according to claim 7, said first end of said second load transit plate being positioned in a groove in said edge of said second structure.

9. The dilation joint according to claim 8, said first transit load plate having stiffening ribs.

* * * * *

UNITED STATES PATENT AND TRADEMARK OFFICE

CERTIFICATE OF CORRECTION

PATENT NO. : 5,600,860
DATED : February 11, 1997
INVENTOR(S) : Roberto Marnetto

It is certified that error appears in the above-indentified patent and that said Letters Patent is hereby corrected as shown below:

Title page, under "[56]", insert --U.S. PATENT DOCUMENTS
5,051,024 9/91 Warthmann--;

under "981946", insert --

| | | |
|---|---|---|
| 1547975 | 10/1968 | FRANCE |
| 2408544 | 8/1975 | WEST GERMANY |
| 581752 | 11/1976 | SWITZERLAND |
| 542785 | 1/1977 | SOVIET UNION |
| 684081 | 9/1979 | SOVIET UNION |
| 684083 | 9/1979 | SOVIET UNION--. |

Signed and Sealed this

Eighteenth Day of November 1997

*Attest:*

Bruce Lehman

BRUCE LEHMAN

*Attesting Officer*

*Commissioner of Patents and Trademarks*